US011746674B2

(12) United States Patent
Tang et al.

(10) Patent No.: US 11,746,674 B2
(45) Date of Patent: Sep. 5, 2023

(54) STEAM TURBINE AND METHOD FOR INTERNALLY COOLING THE SAME

(71) Applicant: Shanghai Electric Power Generation Equipment Co., Ltd., Shanghai (CN)

(72) Inventors: Minjin Tang, Shanghai (CN); Yifeng Hu, Shanghai (CN); Kai Cheng, Shanghai (CN)

(73) Assignee: SHANGHAI ELECTRIC POWER GENERATION EQUIPMENT CO., LTD., Shanghai (CN)

( * ) Notice: Subject to any disclaimer, the term of this patent is extended or adjusted under 35 U.S.C. 154(b) by 104 days.

(21) Appl. No.: 17/288,387

(22) PCT Filed: Apr. 2, 2019

(86) PCT No.: PCT/CN2019/081018
§ 371 (c)(1),
(2) Date: Apr. 23, 2021

(87) PCT Pub. No.: WO2020/093649
PCT Pub. Date: May 14, 2020

(65) Prior Publication Data

US 2021/0381394 A1 Dec. 9, 2021

(30) Foreign Application Priority Data

Nov. 6, 2018 (CN) ..... 201811313083.4

(51) Int. Cl.
*F01D 25/12* (2006.01)
*F01D 5/02* (2006.01)
(Continued)

(52) U.S. Cl.
CPC ..... *F01D 25/12* (2013.01); *F01D 3/04* (2013.01); *F01D 5/02* (2013.01); *F01D 25/14* (2013.01);
(Continued)

(58) Field of Classification Search
CPC .... F01D 3/04; F05D 2220/31; F05D 2220/72; F05D 2240/52; F05D 2260/20; F05D 2300/17
See application file for complete search history.

(56) References Cited

U.S. PATENT DOCUMENTS 2,796,231 A 6/1957 Hertl

FOREIGN PATENT DOCUMENTS

CN 101052782 A 10/2007
CN 108204253 A 6/2018
(Continued)

OTHER PUBLICATIONS

International Search Report and Written Opinion dated May 14, 2020 in PCT International Application No. PCT/CN2019/081018. (English translation of International Search Report).
(Continued)

*Primary Examiner* — Courtney D Heinle
*Assistant Examiner* — Danielle M. Christensen
(74) *Attorney, Agent, or Firm* — Amster, Rothstein & Ebenstein LLP

(57) ABSTRACT

A steam turbine and a method for internally cooling the same. The steam turbine includes an outer casing and an inner casing; a rotor having a balancing piston, the rotor being rotatably mounted inside the inner casing; and a steam flow channel formed between the inner casing and the rotor. Moving blades fitted with the rotor and stationary blades fitted with the inner casing are alternately arranged to form multiple stages of blade groups, and an interlayer for steam to circulate is formed between the inner casing and the outer casing. The multiple stages of blade groups include a first set blade staging and a second set blade staging; and the top of the balancing piston is provided with a first chamber and a second chamber. A first channel disposed in the inner casing
(Continued)

connects the flow passage downstream of the first set blade staging to the first chamber; and a second channel connects the second chamber to the interlayer and connects the interlayer to the flow passage downstream of the second set blade staging.

13 Claims, 3 Drawing Sheets

(51) Int. Cl.
*F01D 25/14* (2006.01)
*F01D 25/26* (2006.01)
*F01D 3/04* (2006.01)

(52) U.S. Cl.
CPC ..... *F01D 25/26* (2013.01); *F05D 2220/31* (2013.01); *F05D 2240/52* (2013.01); *F05D 2260/20* (2013.01); *F05D 2300/17* (2013.01)

(56) References Cited

FOREIGN PATENT DOCUMENTS

| | | | | | |
|---|---|---|---|---|---|
| CN | 109162772 | A | | 1/2019 | |
| CN | 109902426 | A | * | 6/2019 | |
| EP | 1 624 155 | A1 | | 2/2006 | |
| EP | 1 780 376 | A1 | | 5/2007 | |
| EP | 2410128 | A1 | * | 1/2012 | ..... F01D 11/005 |
| EP | 2 554 789 | A1 | | 2/2013 | |
| EP | 2554789 | A1 | * | 2/2013 | ..... F01D 3/04 |
| EP | 3 130 748 | A1 | | 2/2017 | |

OTHER PUBLICATIONS

European Patent Office, Supplementary European Search Report dated Aug. 3, 2022 in European Application No. 19883162.0, 9 pages.

* cited by examiner

STEAM TURBINE AND METHOD FOR INTERNALLY COOLING THE SAME

CROSS-REFERENCE TO RELATED APPLICATIONS

This application is a U.S. national stage entry under 35 U.S.C. § 371 of PCT International Patent Application No. PCT/CN2019/081018, filed Apr. 2, 2019, which claims priority to Chinese Patent Application No. 201811313083.4, filed Nov. 6, 2018, the contents of each of which are incorporated herein by reference in their entirety.

FIELD

Embodiments of the present disclosure relate to a steam turbine and a method for internally cooling the same.

BACKGROUND

A steam turbine is a rotary steam-powered machine, customarily comprising a rotatably mounted rotor fitted with blades, the rotor being installed inside a casing shell. When heated and pressurized steam is flowing through a flow space formed by the casing shell, the rotor is set in rotation via the blades.

For reasons of efficiency, operating parameters (e.g., steam pressure and steam temperature) of the steam turbine become increasingly high; however, heat resistance property of the steam turbine is limited by the strength and material of its component parts. To guarantee reliable operation at an especially high temperature, the component parts need to be cooled individually. Without efficient cooling in the case of temperature rise, the component parts have to be manufactured with significantly more expensive materials (for example, nickel-based alloys).

In the hitherto known cooling methods, especially for the component parts (such as casing or rotor) of the steam turbine, a distinction is to be made between an active cooling and a passive cooling. In the case of active cooling, the cooling is effectuated by a cooling medium which is fed separately (i.e., in addition to a working medium) to the component parts. In contrast, the passive cooling takes place purely by means of a suitable guiding or by application of the working medium. Up to now, the component parts of conventional steam turbines have been preferably passively cooled.

As shown in FIG. 1, it is set out in "*Thermal Power Plant Equipment Manual—Volume II—Steam Turbine, China Machine Press,* 1999" that typically, the pressure upstream of the balancing piston is referred to as inlet pressure, while the pressure downstream of the balancing piston is referred to as exhaust pressure, wherein a large pressure differential exists between upstream and downstream of the balancing piston. As such a steam turbine does not have an internal cooling passage, the inlet steam directly accesses the interlayer between the inner and outer casings, exposing the interlayer to a high temperature and a high pressure; therefore, the temperature of the steam admitted into the casings needs to be contained below 566° C., typically set to 550° C. or 538° C.

The patent CN200580033477.9 discloses a steam turbine, wherein two cooling passages are provided to enable effective cooling to the interlayer between the inner and outer casings, as well as to the balancing piston of the rotor, thereby supporting a higher inlet temperature, typically 600° C. Specifically, as shown in FIG. 2, the steam turbine comprises: an outer casing 2 and an inner casing 3, wherein the outer casing 2 and the inner casing 3 are provided with a live steam feed channel 10; and a rotor 5 rotatably mounted inside the inner casing 3, the rotor 5 having a thrust balancing piston 4 and comprising a plurality of moving blades 7; wherein a plurality of stationary blades 8 are arranged on the inner casing 3 in such a manner that the plurality of stationary blades 8 form, in a flow direction 11, a steam flow channel 9 comprising a plurality of blade stages; after traversing one blade stage, the steam flows through a return channel 14 within the inner casing 3 into a chamber 15 between the inner casing 3 and the outer casing 2, and then from the chamber 15, flows through a feed channel 16 within the inner casing 3 into a thrust balancing piston antechamber 12 that is disposed in an axial direction 17 between the thrust balancing piston 4 and the inner casing 3; and wherein thrust balance is achieved via the steam in the thrust balancing piston antechamber 12.

The live steam feed is shown symbolically by the arrow 13: the live steam admitted into the live steam feed channel 10 flows for the most part along the flow direction into the flow channel 9, while a smaller part flows as leakage steam into a sealed chamber 18 disposed between the rotor 5 and the inner casing 3. In this case, the leakage steam flows basically along an opposite direction 19. The sealed chamber 18 is located between a sideling placed stationary blade and the thrust balancing piston 4. The sideling placed stationary blade is customarily a non-vertical first-stage stationary blade, functioning to prevent the rotor from being directly exposed to the steam, which can modestly reduce rotor temperature to thereby enhance rotor strength or may modestly raise inlet parameters.

The steam in the sealed chamber 18 flows through a cross-return channel 20 arranged in the inner casing 3 into an inflow chamber 26 which is disposed downstream of one blade stage, wherein symbols 21, 22 represent two turns of the cross-return channel 20; meanwhile, supplemental steam flows into the inflow chamber 26 via a load inlet pipe 23 which extends through the outer casing 2 and the inner casing 3. The return channel 14, after traversing one return blade stage 24, is connected to the flow channel 9; and the cross-return channel 20, after traversing one cross-return blade stage 25, is connected to the flow channel 9, wherein the cross-return blade stage 25 is disposed downstream of the return blade stage 24 along the flow direction 11 of the flow channel 9.

The known steam turbine has the following drawbacks:

1) the rotor balancing piston has a relatively large diameter, resulting in a relatively high cost in purchasing rotor forgings. In the known solution, the pressure at the balancing piston antechamber 12 is the pressure downstream of the fourth or fifth blade stage, which is a larger pressure, while the exhaust pressure downstream of the balancing piston is a smaller pressure, wherein the pressure differential between upstream and downstream of the balancing piston is relatively small; as such, to balance the thrust in the region of the blades, the balancing piston needs to be configured with a relatively large diameter;

2) a steam-tight segment is provided upstream of the rotor balancing piston, with a sealed chamber being formed between the sideling placed stationary blade and the balancing piston to isolate the steam downstream of the sideling placed stationary blade from the steam that has a different parameter within the balancing piston antechamber, resulting in a complex structure for the casings and the rotor.

SUMMARY

Disclosed are a steam turbine and a method for internally cooling the same. By optimizing the cooling paths in the casings, the present disclosure simplifies the seal construction upstream of the balancing piston, reduces the rotor diameter, lowers the rotor costs, and reduces casing diameters; besides, the casing constructions can also be simplified.

In one aspect of the present disclosure, there is provided a steam turbine, comprising: an outer casing and an inner casing; a rotor having a balancing piston, the rotor being rotatably mounted inside the inner casing; and a steam flow channel formed between the inner casing and the rotor, wherein a plurality of moving blades fitted with the rotor and a plurality of stationary blades fitted with the inner casing are alternately arranged to form multiple stages of blade groups, and an interlayer for steam to circulate is formed between the inner casing and the outer casing;

the multiple stages of blade groups include a first set blade staging and a second set blade staging; and the top of the balancing piston is provided with a first chamber and a second chamber; and a first channel disposed in the inner casing connects the flow passage downstream of the first set blade staging to the first chamber; and a second channel connects the second chamber to the interlayer and connects the interlayer to the flow passage downstream of the second set blade staging.

Alternatively, the first channel and the second channel are laid out such that the first channel connects the flow passage downstream of the first set blade staging to the interlayer and connects the interlayer to the first chamber, and the second channel disposed in the inner casing connects the second chamber to the flow passage downstream of the second set blade staging; and a piston section of the balancing piston corresponding to the first chamber has the same diameter as a piston section corresponding to the second chamber.

Optionally, the inner casing and the outer casing are provided with a live steam feed channel via which live steam is admitted into an inlet steam chamber; and the second chamber is disposed proximal to the inlet steam chamber, and the first chamber is disposed distant from the inlet steam chamber, the second chamber and the first chamber being arranged in a fore-and-aft manner along the axial direction of the rotor.

Optionally, a sideling placed stationary blade is provided for the inlet steam chamber in the inner casing upstream of the balancing piston, the pressure upstream of the balancing piston corresponding to the pressure downstream of the sideling placed stationary blade; or, the inlet steam chamber is free of the sideling placed stator, the pressure upstream of the balancing piston corresponding to the inlet pressure.

Optionally, a steam supplementing pipe extending through the outer casing into the inner casing is provided communicating with the second channel or communicating with a steam supplementing chamber proximal to the second channel in the inner casing so as to introduce supplemental steam.

Optionally, a steam supplementing pipe extending through the outer casing is provided communicating with the interlayer between the inner casing and the outer casing or communicating with a steam supplementing chamber formed at the interlayer so as to introduce supplemental steam.

Optionally, the balancing piston is a single-diameter piston.

Optionally, the second set blade staging is disposed downstream of the first set blade staging in the flow channel and spaced from the first set blade staging by one or more blade stages; the first set blade staging corresponds to the fourth blade stage or the fifth blade stage in the flow channel.

Optionally, the rotor is made of X12CrMoWVNbN10 or FB2 material.

In another aspect of the present disclosure, there is provided a method for internally cooling a steam turbine, implemented by any steam turbine described above; wherein the inner casing and the outer casing of the steam turbine are provided with a live steam feed channel to feed live steam into an inlet steam chamber within the inner casing, wherein the live steam starts from the inlet steam chamber into a flow channel between the inner casing and the rotor, and circulates around respective blade stage so as to be expanded and cooled, thereby releasing heat energy to drive the rotor to rotate;

conveying, via a first channel in the inner casing, the steam from the flow passage downstream of a first designated blade staging in multiple stages of blade groups to a first chamber on the top of a balancing piston; and conveying, via a second channel, the steam from a second chamber on the top of the balancing piston till an interlayer between the inner casing and the outer casing, and then from the interlayer to the flow passage downstream of a second designated blade staging to continue working;

or, conveying, via the first channel, the steam from the flow passage downstream of the first designated blade staging in the multiple stages of blade groups till the interlayer between the inner casing and the outer casing, and then from the interlayer to the first chamber on the top of the balancing piston; and conveying, via the second channel in the inner casing, the steam from the second chamber on the top of the balancing piston to a flow passage downstream of the second designated blade staging to continue working;

wherein the pressure upstream of the balancing piston corresponds to the pressure downstream of the sideling placed stationary blade or corresponds to the inlet pressure.

In the conventional steam turbine solution, the first cooling passage connects the flow passage downstream of the fourth or fifth blade stage to the thrust balancing piston antechamber, and the second cooling passage connects the sealed chamber between downstream of the first stage stationary blade and the thrust balancing piston with downstream of the next blade stage. That is, a steam-tight segment is provided upstream of the thrust balancing piston of the rotor to isolate the steam downstream of the first stage stationary blade from the steam that has a different parameter in the balancing piston antechamber; before introducing the cooling steam from the interlayer into the thrust balancing piston, the temperature of the thrust balancing piston is lowered, wherein the pressure differential between upstream and downstream of the thrust balancing piston is small, resulting in a relatively large piston diameter and a high expense in purchasing rotor forgings.

In contrast, the solution according to the present disclosure makes adjustments to the two cooling paths. For example, in Embodiment 1, the top of the balancing piston is partitioned into three segments by providing the first chamber distant from the inlet steam chamber and the second chamber proximal to the inlet steam chamber, and accesses the interlayer between the inner casing and the outer casing from downstream of one blade stage and then communicates with the first chamber, while the second chamber communicates with downstream of the next blade stage. Upstream of the balancing piston is the steam downstream of the sideling placed stationary blade (or the inlet stream in the case of absence of the sideling placed stationary blade), rather than the cooling steam. Meanwhile, downstream of the sideling placed stationary blade communicates with the balancing piston, wherein no steam-tight segment is provided upstream of the balancing piston. As the pressure upstream of the balancing piston is significantly higher than the conventional solution, the pressure differential in the present disclosure is larger, resulting in a smaller stressed area for the balancing piston and thus a smaller diameter of the balancing piston, which thereby effectively reduces rotor costs.

In conventional solutions, the pressure upstream of the balancing piston is 18 MPa, the pressure differential 18−6.5 MPa=11.5 MPa. The diameter of the balancing piston is 1045 mm. The strength margin (actual stress/allowable stress)=0.65. In the present disclosure, the pressure upstream of the balancing piston is 26.3 MPa, the pressure differential 26.3−6.5 MPa=19.8 MPa. The diameter of the balancing piston is 975 mm. The strength margin (actual stress/allowable stress)=0.75.

In the conventional solution, cooling lowers rotor temperature but practically raises the allowable stress; the drawback is that the smaller pressure differential leads to a larger diameter and thus a larger actual stress of the balancing piston. In contrast, in the present disclosure, provision of two cooling passages eliminates the need of a steam-tight segment and a sealed chamber between downstream of the sideling placed stationary blade and the balancing piston, resulting in a smaller piston diameter, further reducing casing diameters; besides, the rotor and the casings have a simplified structure, effectively reducing casing costs.

Furthermore, in the present disclosure, as upstream of the balancing piston is the stream downstream of the sideling placed stationary blade or the inlet steam, rather than cooling steam, although the rotor temperature is slightly higher than the conventional solution, its strength can still satisfy requirements. This manner can achieve a balance between cost and safety. While ensuring strength and safety, the cooling loop is also simplified, thereby achieving objectives of reducing rotor diameter, lowering costs, and simplifying casing constructions.

As the present disclosure has a slightly weaker cooling effect, the balancing piston section of the rotor has a relatively small strength margin. To address this issue, the profile line of the balancing piston section of the rotor can be further optimized to reduce stress concentration and ensure qualified strength. Meanwhile, to enhance cooling effect of the present disclosure, flow field analysis, strength calculation, cooling steam amount optimization, and efficiency calculation may also be performed.

Besides, the present disclosure may also exploit the latest material technologies: the rotor material required by the current 600° C. inlet parameter is 600° C.-grade X12CrMoWVNbN10 material. In recent years, with advancement of material technologies, 625° C.-grade FB2 material has emerged. The 625° C.-grade FB2 material has better properties than conventional materials, but without significant price gap from the latter. Therefore, thanks to the advancement of material technologies, the present disclosure is not only implemented with conventional materials to reduce the strength margin, but also may be implemented with new materials to reduce rotor diameter without lowering safety margin, thereby achieving the objective of reducing costs.

According to another embodiment of the present disclosure, layout of the cooling passages may be further adjusted to provide more options for parameter optimization: one route is to connect downstream of the first blade stage to the first chamber on the top of the balancing piston via the passage in the inner casing; and the other route is to connect the second chamber to the downstream of the next blade via the passage in the interlayer.

Meanwhile, the steam supplementing chamber is alternatively absent inside the inner casing; instead, supplemental steam mixing is enabled via the interlayer between the inner casing and the outer casing; therefore, the steam supplementing pipe inserted into the inner casing is eliminated, which renders a more flexible configuration as to the spatial position for the supplemental steam (e.g., the spatial position is movable fore-and-aft axially in the interlayer area). This is also beneficial to inner casing strength.

Besides, the casings referred to herein are mainly barrel-shaped casings, i.e., the outer casing is a full-circle structure of a drum shape, without casing splits, not an upper-lower halved structure.

DETAILED DESCRIPTION OF THE ILLUSTRATED EMBODIMENTS

Hereinafter, preferred embodiments of the present disclosure will be illustrated in further detail with reference to the accompanying drawings.

Embodiment I

Figure 1:
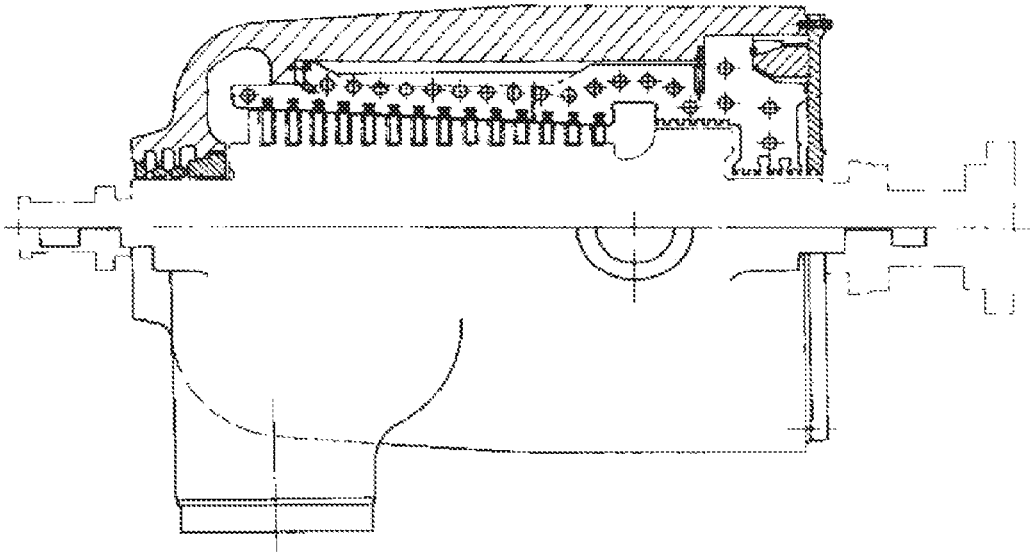
Fig. 1 (Prior Art)
FIG. 1 shows a structural schematic diagram of a conventional steam turbine without internal cooling passages.
Figure 2:
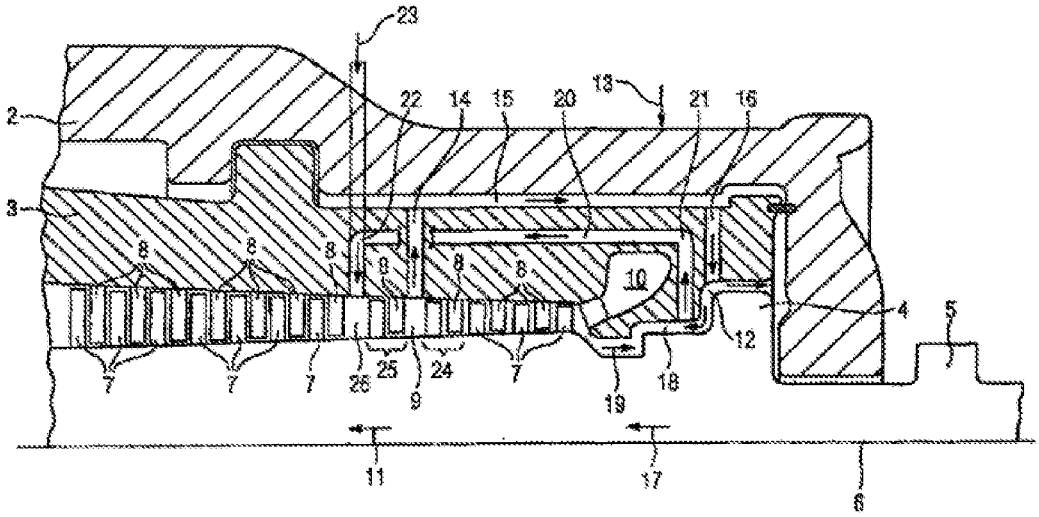
Fig.2 (Prior Art)
FIG. 2 shows a structural schematic diagram of a conventional steam turbine with two cooling passages.
Figure 3:
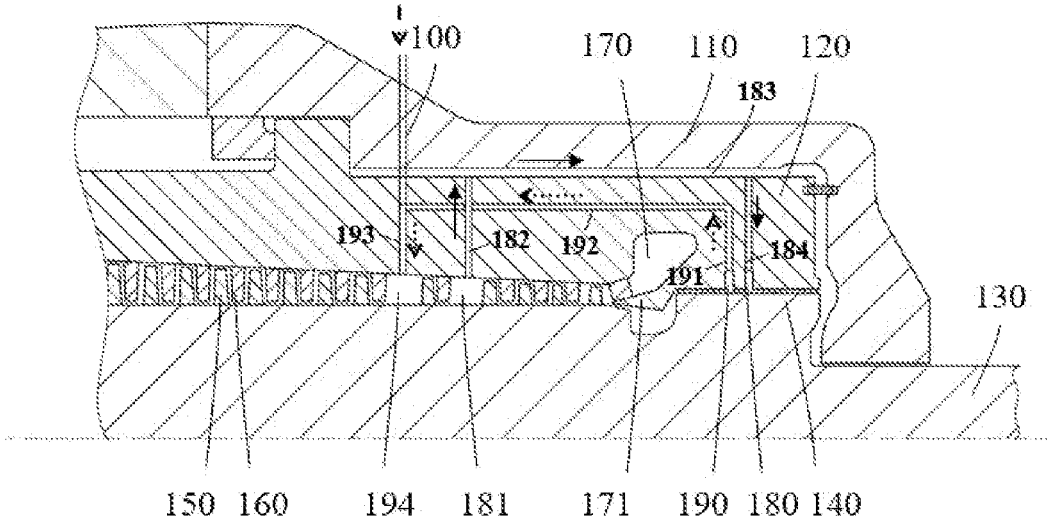
FIG. 3 shows a structural schematic diagram of a steam turbine with a sideling placed stationary blade according to Embodiment 1 of the present disclosure.

As shown in FIG. 3, the steam turbine comprises an outer casing 110 and an inner casing 120, and a rotor 130 having a balancing piston 140, the rotor 130 being rotatably mounted inside the inner casing 120. A flow channel for a medium (e.g., steam) is formed between the inner casing 120 and the rotor 130, the flow channel substantially running along the axial direction of the rotor 130. The flow channel is alternately arranged with moving blades 150 fitted with the rotor 130 and stationary blades 160 fitted with the inner casing 120, forming multiple stages of blade groups. The inner casing 120 and the outer casing 110 are provided with a live stream feed channel (not shown) via which the live steam is admitted into the inlet steam chamber 170, where the live steam enters the flow channel and circulates downstream around respective blade stage; with expansion and cooling of the live steam, heat energy is released to drive the rotor 130 to rotate.

In this embodiment, with the first channel configured, the steam is enabled to flow into an interlayer 183 between the inner casing 120 and the outer casing 110 via a first connection pipe 182 in the inner casing 120 from the flow passage 181 downstream of one of the blade stages (referred to as the first blade staging) in the flow channel, and then from the interlayer 183, to flow into the first chamber 180 on the top of the balancing piston 140 via a second connecting pipe 184 in the inner casing 120.

In this embodiment, a second chamber 190 is further provided on the top of the balancing piston 140. The second chamber 190 is proximal to the inlet steam chamber 170, and the first chamber 180 is distant from the inlet steam chamber 170; the second chamber 190 and the first chamber 180 are arranged with a fore-and-aft spatial position relationship in the axial direction. The steam flows from the second chamber 190 into the flow passage 194 downstream of another one of the blade grades (referred to as the second blade staging) in the flow channel via the second channel arranged in the inner casing 120.

The first chamber 180 and the second chamber 190 may be a spatial structure of any shape, respectively formed in the inner casing 120 (or in some examples, formed at the balancing piston 140, or determined by respective shapes of the inner casing 120 and the balancing piston 140 at the interface therebetween).

In an exemplary first channel, the first connection pipe 182 extends upward within the inner casing 120 in a direction substantially perpendicular to the axis till accessing the interlayer 183, which is substantially parallel to the axis, between the inner casing 120 and the outer casing 110, and the second connection pipe 184 led out from the interlayer 183 further extends downward in the inner casing 120 in a direction substantially perpendicular to the axis till accessing the first chamber 180.

The exemplary second channel experiences two turns in the inner casing 120. In this example, a first pipe segment 191 led out from the second chamber 190 extends upward in a direction substantially perpendicular to the axis, and a second pipe segment 192 following the first turn extends in a direction substantially parallel to the axis, and a third pipe segment 193 following the second turn extends further downward in a direction substantially perpendicular to the axis till accessing the flow passage 194 downstream of the second blade staging.

Meanwhile, a steam supplementing pipe 100 extending through the outer casing 110 till accessing the inner casing 120 is provided communicating with the second channel (e.g., communicating with the third pipe segment 193 downstream of the second turn) or communicating with a steam supplementing chamber (not shown) disposed in the inner casing 120 adjacent to the third pipe segment 193, further conveying the introduced supplemental steam (schematically represented by the dotted-line arrow) to the flow passage 194 downstream of the second blade staging.

The second blade staging in the flow channel corresponding to the second chamber 190 is disposed downstream of the first blade staging corresponding to the first chamber 180, wherein the second blade staging and the first blade staging may be spaced by one or more stages of (e.g., two) blade groups. In this embodiment, the first blade staging is for example the fourth blade stage or the fifth blade stage.

In an alternative embodiment, the exemplary balancing piston 140 is a single-diameter piston.

In the example illustrated in FIG. 3, a sideling placed stationary blade 171 is provided in the inner casing 120 at the position corresponding to the inlet steam chamber 170 upstream of the balancing piston 140, i.e., the pressure upstream of the balancing piston 140 corresponds to the pressure downstream of the sideling placed stationary blade 171. The sideling placed stationary blade 171 is configurable to prevent the rotor 130 from being directly exposed to the steam, which can modestly lower the temperature of the rotor 130, so as to be beneficial to enhance strength of the rotor 130 or modestly raise the inlet parameters.

For example, the inlet steam has a temperature of 600° C. and a pressure of 27 MPa; downstream of the sideling placed stationary blade 171 has a temperature of 594° C. and a pressure of 26.3 MPa; downstream of the fourth blade stage has a temperature of 540° C. and a pressure of 18 MPa; downstream of the fifth stage blade has a temperature of 525° C. and a pressure of 16.5 MPa; the exhaust steam has a pressure of 6.5 MPa.

Figure 4:
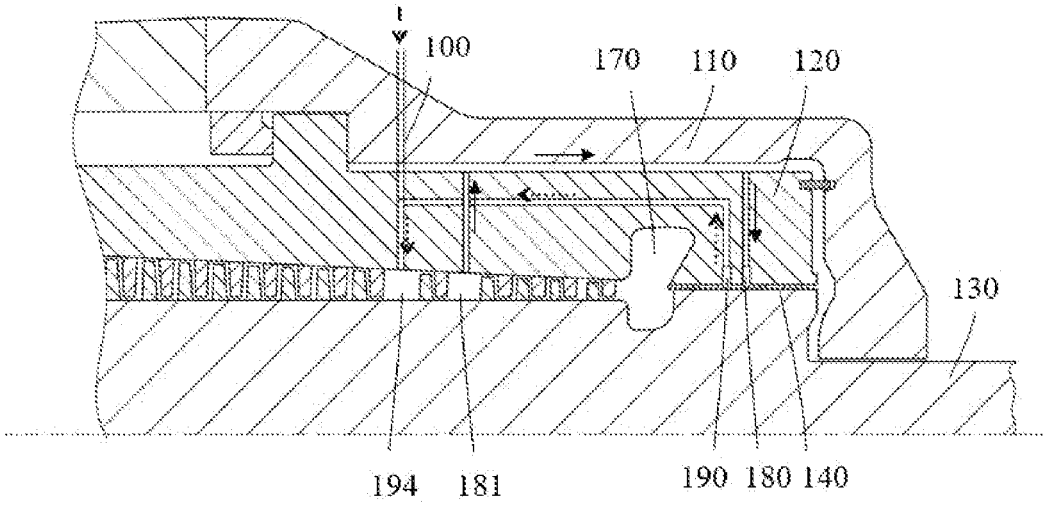
FIG. 4 shows a structural schematic diagram of a steam turbine without a sideling placed stationary blade according to Embodiment 1 of the present disclosure.

In another example illustrated in FIG. 4, the sideling placed stationary blade is absent upstream of the balancing piston 140, i.e., the pressure upstream of the balancing piston 140 corresponds to the inlet pressure.

Embodiment 2

Figure 5:
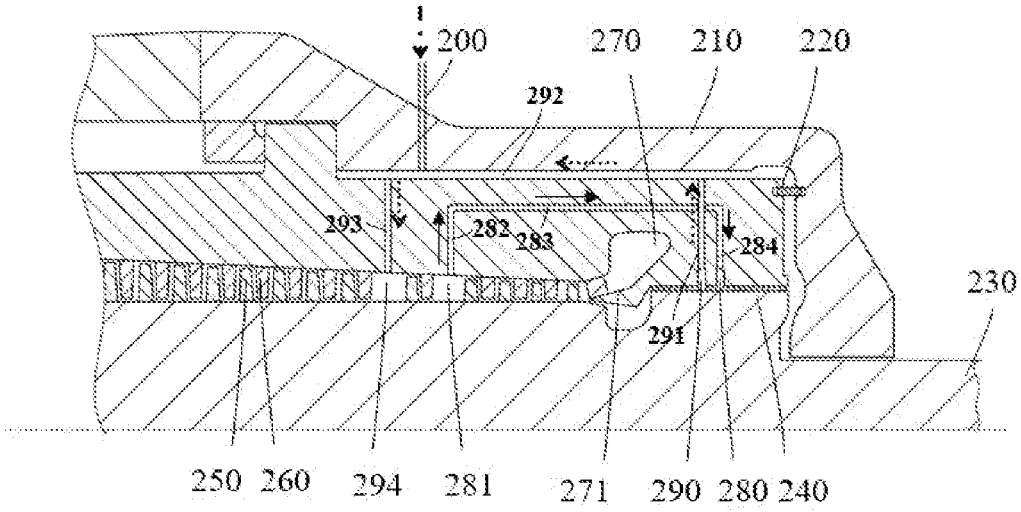
FIG. 5 shows a structural schematic diagram of a steam turbine with a sideling placed stationary blade according to Embodiment 2 of the present disclosure.

As illustrated in FIG. 5, in the steam turbine according to this embodiment, the basic constructions of the outer casing 210, the inner casing 220, the rotor 230, the balancing piston 240, the first chamber 280, the second chamber 290, and the moving blades 250 and stationary blades 260 in multiple stages of blade groups are all identical to Embodiment 1. The main differential lies in the manner of arranging the first channel, the second channel, and the steam supplementing construction.

In this embodiment, the first channel is wholly provided within the inner casing 220, the input end of which communicates with a flow passage 281 downstream of the first blade staging in the flow channel running along the axial direction of the rotor 230, and the output end of which communicates with the first chamber 280 on the top of the balancing piston 240. With the second channel configured in this embodiment, the steam is admitted into the interlayer 292 between the inner casing 220 and the outer casing 210 from a second chamber 290 on the top of the balancing piston 240 via a first connection pipe 291, and is then conveyed to the flow passage 294 downstream of the second blade staging in the flow channel via a second connection pipe 293 connected to the interlayer 292.

In this embodiment, the second chamber 290 is proximal to the inlet steam chamber 270, and the first chamber 280 is distant from the inlet steam chamber 270; the second chamber 290 and the first chamber 280 are arranged with a fore-and-aft spatial position relationship in the axial direction. The second blade staging corresponding to the second chamber 290 is disposed downstream of the first blade staging corresponding to the first chamber 280; the second blade staging and the first blade staging may be spaced by one or more stages (e.g., two stages) of blade groups. The first blade staging is for example the fourth blade stage or the fifth blade stage.

The exemplary first channel experiences two turns in the inner casing 220. In this example, a first pipe segment 282 led out from the flow passage downstream of the second blade staging extends upward in a direction substantially perpendicular to the axis, and a second pipe segment 283 following the first turn extends in a direction substantially parallel to the axis, and a third pipe segment 284 following the second turn extends further downward in a direction substantially perpendicular to the axis till accessing the first chamber 280.

In an exemplary second channel, the first connection pipe 291 led out from the second chamber 290 extends upward within the inner casing 220 in a direction substantially perpendicular to the axis till accessing the front segment of the interlayer 292, which is substantially parallel to the axis, between the inner casing 220 and the outer casing 210, and then the second connection pipe 293 is led out from a certain position at the rear segment of the interlayer 292, the second connection pipe 293 extending downward in the inner casing 220 in the direction substantially perpendicular to the axis till accessing the flow passage 294 downstream of the first blade staging.

In an alternative embodiment, the exemplary balancing piston 240 is a single-diameter piston.

Figure 6:
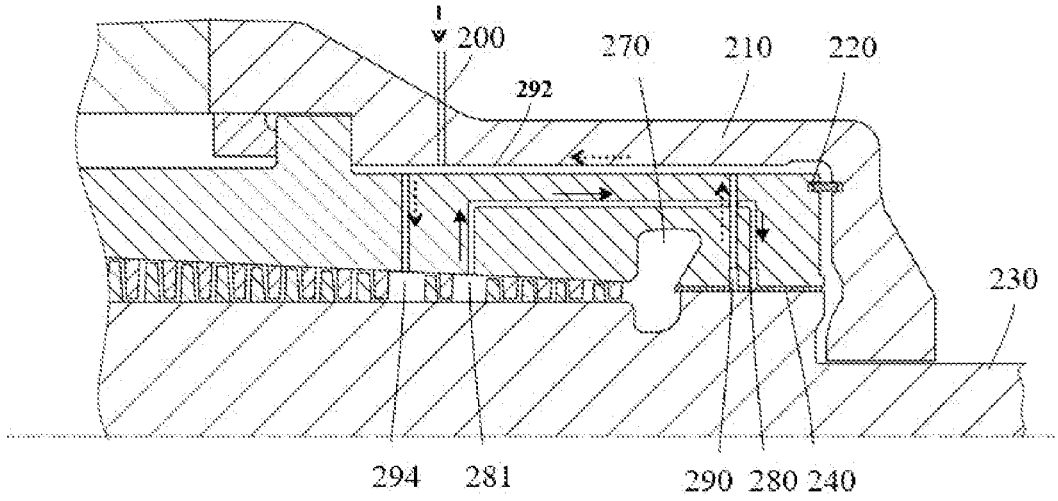
FIG. 6 shows a structural schematic diagram of a steam turbine without a sideling placed stationary blade according to Embodiment 2 of the present disclosure.

In the example illustrated in FIG. 5, a sideling placed stationary blade 271 is provided in the inner casing 220 at the position corresponding to the inlet steam chamber 270 upstream of the balancing piston 240, i.e., the pressure upstream of the balancing piston 240 corresponds to the pressure downstream of the sideling placed stationary blade 271. In another example illustrated in FIG. 6, the sideling placed stationary blade is absent upstream of the balancing piston 240, i.e., the pressure upstream of the balancing piston 240 corresponds to the inlet pressure.

The steam supplementing pipe 220 in this embodiment, after extending through the outer casing 210, accesses the interlayer 292 between the inner casing 220 and the outer casing 210 to introduce supplemental steam to be mixed with the steam that accesses the interlayer 292 from the second chamber 290. The access position of the steam supplementing pipe 200 in the region of the interlayer is not limited, wherein the steam supplementing pipe 200 is movable fore-and-aft along the axial direction.

Illustratively, a steam supplementing chamber surrounding the outer side of the inner casing 220 may be provided in the region of the interlayer between the inner casing 220 and the outer casing 210. The steam supplementing chamber may be a spatial structure of any shape, defined by respective body shapes of the outer casing 210 and the inner casing 220 at the position where the steam supplementing chamber is provided. For example, the steam supplementing chamber is an annular chamber.

In view of the above, a steam turbine and a method of internally cooling the same are provided, wherein by providing two cooling passages within the steam turbine, the first chamber and the second chamber on the top of the balancing piston are respectively connected to the flow channels downstream of their corresponding blade stages, which simplifies the cooling loop while guaranteeing qualified strength and safety, thereby achieving the objectives of reducing rotor diameter, lowering costs, and simplifying casing structures.

Although the contents of the present disclosure have been described in detail through the foregoing preferred embodiments, it should be understood that the depictions above shall not be regarded as limitations to the present disclosure. After those skilled in the art having read the contents above, many modifications and substitutions to the present disclosure are all obvious. Therefore, the protection scope of the present disclosure should be limited by the appended claims.

What is claimed is:

1. A steam turbine, comprising: an outer casing and an inner casing; a rotor having a balancing piston, the rotor being rotatably mounted inside the inner casing; and a steam flow channel formed between the inner casing and the rotor, wherein a plurality of moving blades fitted with the rotor and a plurality of stationary blades fitted with the inner casing are alternately arranged to form multiple stages of blade groups, an interlayer for steam to circulate is formed between the inner casing and the outer casing, and live steam is sent into an inlet steam chamber inside the inner casing and enters the flow channel from the inlet steam chamber; wherein:

the multiple stages of blade groups include a first set blade staging and a second set blade staging; and the top of the balancing piston is provided with a first chamber and a second chamber; and a first channel disposed in the inner casing connects the flow passage downstream of the first set blade staging to the first chamber; and a second channel connects the second chamber to the interlayer and connects the interlayer to the flow passage downstream of the second set blade staging;

wherein the second chamber is disposed proximal to the inlet steam chamber, the first chamber is disposed distant from the inlet steam chamber, the second chamber and the first chamber being arranged in a fore-and-aft manner along the axial direction of the rotor.

2. The steam turbine according to claim 1, wherein:

a sideling placed stationary blade is provided for the inlet steam chamber in the inner casing upstream of the balancing piston, the pressure upstream of the balancing piston corresponding to the pressure downstream of the sideling placed stationary blade; or, the inlet steam chamber is free of the sideling placed stator, the pressure upstream of the balancing piston corresponding to the inlet pressure.

3. The steam turbine according to claim 2, wherein:

the balancing piston is a single-diameter piston.

4. The steam turbine according to claim 2, wherein:

the second set blade staging is disposed downstream of the first set blade staging in the flow channel and spaced from the first set blade staging by one or more blade stages; and the first set blade staging corresponds to the fourth blade stage or the fifth blade stage in the flow channel.

5. The steam turbine according to claim 1, wherein:

a steam supplementing pipe extending through the outer casing is provided communicating with the interlayer between the inner casing and the outer casing or communicating with a steam supplementing chamber formed at the interlayer so as to introduce supplemental steam.

6. The steam turbine according to claim 1, wherein:

the rotor is made of X12CrMoWVNbN10 or FB2 material.

7. A steam turbine, comprising: an outer casing and an inner casing; a rotor having a balancing piston, the rotor being rotatably mounted inside the inner casing; and a steam flow channel formed between the inner casing and the rotor, wherein a plurality of moving blades fitted with the rotor and a plurality of stationary blades fitted with the inner casing are alternately arranged to form multiple stages of blade groups, and an interlayer for steam to circulate is formed between the inner casing and the outer casing; wherein:

the multiple stages of blade groups include a first set blade staging and a second set blade staging; and the top of the balancing piston is provided with a first chamber and a second chamber; and a first channel connects the flow passage downstream of the first set blade staging to the interlayer and connects the interlayer to the first chamber; and the second channel disposed in the inner casing connects the second chamber to the flow passage downstream of the second set blade staging; and a piston section of the balancing piston corresponding to the first chamber has the same diameter as a piston section corresponding to the second chamber.

8. The steam turbine according to claim 7, wherein:

live steam is sent into an inlet steam chamber inside the inner casing and enters the flow channel from the inlet steam chamber; and the second chamber is disposed proximal to the inlet steam chamber, and the first chamber is disposed distant from the inlet steam chamber, the second chamber and the first chamber being arranged in a fore-and-aft manner along the axial direction of the rotor.

9. The steam turbine according to claim 8, wherein:

a sideling placed stationary blade is provided for the inlet steam chamber in the inner casing upstream of the balancing piston, the pressure upstream of the balancing piston corresponding to the pressure downstream of the sideling placed stationary blade; or, the inlet steam chamber is free of the sideling placed stator, the pressure upstream of the balancing piston corresponding to the inlet pressure.

10. The steam turbine according to claim 9, wherein:

the balancing piston is a single-diameter piston.

11. The steam turbine according to claim 9, wherein:

the second set blade staging is disposed downstream of the first set blade staging in the flow channel and spaced from the first set blade staging by one or more blade stages; and the first set blade staging corresponds to the fourth blade stage or the fifth blade stage in the flow channel.

12. The steam turbine according to claim 7, wherein:

a steam supplementing pipe extending through the outer casing into the inner casing is provided communicating with the second channel or communicating with a steam supplementing chamber proximal to the second channel in the inner casing so as to introduce supplemental steam.

13. The steam turbine according to claim 7, wherein:

the rotor is made of X12CrMoWVNbN10 or FB2 material.

* * * * *